US010243291B2

(12) United States Patent
Shibuya

(10) Patent No.: US 10,243,291 B2
(45) Date of Patent: Mar. 26, 2019

(54) ELECTRICAL CONNECTOR FOR CIRCUIT BOARD

(71) Applicant: Hirose Electric Co., Ltd., Tokyo (JP)

(72) Inventor: Kazunari Shibuya, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 19 days.

(21) Appl. No.: 15/657,192

(22) Filed: Jul. 23, 2017

(65) Prior Publication Data

US 2018/0026384 A1 Jan. 25, 2018

(30) Foreign Application Priority Data

Jul. 25, 2016 (JP) ..... 2016-145079

(51) Int. Cl.

| | |
|---|---|
| ***H01R 12/73*** | (2011.01) |
| ***H01R 12/91*** | (2011.01) |
| ***H01R 12/71*** | (2011.01) |
| ***H01R 31/06*** | (2006.01) |

(52) U.S. Cl.

CPC ..... *H01R 12/737* (2013.01); *H01R 12/716* (2013.01); *H01R 12/91* (2013.01); *H01R 31/06* (2013.01)

(58) Field of Classification Search

CPC ... H01R 12/737; H01R 13/6315; H01R 12/91
USPC ..... 439/637, 247, 248
See application file for complete search history.

(56) References Cited

U.S. PATENT DOCUMENTS

| | | | | |
|---|---|---|---|---|
| 7,637,762 | B2 * | 12/2009 | Uesaka | H01R 12/57 439/247 |
| 9,022,811 | B2 * | 5/2015 | Takaki | H01R 12/70 439/637 |
| 9,033,743 | B2 * | 5/2015 | Kobayashi | H01R 13/11 439/637 |
| 9,484,656 | B2 * | 11/2016 | Doi | H01R 12/65 |
| 9,831,578 | B2 * | 11/2017 | Mizuguchi | H01R 12/712 |

(Continued)

FOREIGN PATENT DOCUMENTS

JP 2002050420 A 2/2002

*Primary Examiner* — Tulsidas C Patel
*Assistant Examiner* — Travis Chambers
(74) *Attorney, Agent, or Firm* — Procopio, Cory, Hargreaves & Savitch LLP

(57) ABSTRACT

An electrical connector with terminals having contact portions that come into contact with a connected circuit board and a housing that supports the terminals. The housing has a stationary housing for attaching to a circuit board and a movable housing configured to move with respect to the stationary housing. The connecting circuit board contacts the contact portions on the movable housing side. The terminals each have a stationary-side supported portion that is supported by the stationary housing, a movable-side supported portion that is supported by the movable housing, and an elastic portion that links the stationary-side supported portion and the movable-side supported portion. The elastic portions each have longitudinal portions extending in the connector mating direction, and a lateral portion extending in a direction perpendicular to the mating direction, and reach the stationary-side supported portions via bent portions that are bent at the inner ends of the lateral portions.

5 Claims, 8 Drawing Sheets

(56) References Cited

U.S. PATENT DOCUMENTS

| | | | | |
|---|---|---|---|---|
| 2006/0258199 | A1* | 11/2006 | Umehara | H01R 13/33 439/247 |
| 2007/0173096 | A1* | 7/2007 | Hayashi | H01R 13/112 439/246 |
| 2007/0202729 | A1* | 8/2007 | Uesaka | H01R 12/57 439/248 |
| 2010/0055952 | A1* | 3/2010 | Fukazawa | H01R 12/707 439/248 |
| 2011/0294326 | A1* | 12/2011 | Tanaka | H01R 12/712 439/248 |
| 2017/0346247 | A1* | 11/2017 | Tamai | H01R 33/7628 |

* cited by examiner

ELECTRICAL CONNECTOR FOR CIRCUIT BOARD

CROSS REFERENCE TO RELATED APPLICATIONS

This Paris Convention Patent Application claims benefit under 35 U.S.C. § 119 and claims priority to Japanese Patent Application No. JP 2016-145079, filed on Jul. 25, 2016, titled "ELECTRICAL CONNECTOR FOR CIRCUIT BOARD", the content of which is incorporated herein in its entirety by reference for all purposes.

BACKGROUND

Technical Field

The present invention relates to an electrical connector for a circuit board, which is attached to a circuit board.

Background Art

When this type of connector is attached to a circuit board and a counterpart connector or a counterpart circuit board (the counterpart connected member) is connected by being mated or inserted at a right angle to the plane of the circuit board, in many cases a so-called "floating" structure is required, which permits relative displacement with the counterpart connected member. Therefore, this type of connector has a stationary housing fixedly attached to the circuit board and a movable housing that is able to move with respect to the stationary housing, and is designed to allow for displacement (movement) of the movable housing in the above-mentioned floating between the stationary housing and the movable housing through elastic portions formed on terminals that are provided spanning the stationary housing and the movable housing.

Floating can involve a total of three linear motion directions, namely, the connection direction of mating or inserting the counterpart connected member and two directions perpendicular to this connection direction, and tilt directions in which there is attempted rotation around a straight line in each of these linear motion directions, but the floating direction that is required for the format of the counterpart connected member is needed.

When the counterpart connected member is a connector, since the housing of that connector is mated to the movable housing, the mating position in the above-mentioned connection direction is naturally a fixed position, floating is not really needed in the connection direction or the tilt direction, and mainly what is needed is mobility in the two directions perpendicular to the above-mentioned connection direction.

On the other hand, when the counterpart connected member is a connected circuit board, the insertion position of the connected circuit board with respect to the contact portion of the terminal within the movable member cannot be precisely established, and in addition to the two directions perpendicular to the connection direction, floating is also needed in the connection direction. Also, since the connected circuit board is relatively thin, there is often a tilt at the contact point with the above-mentioned contact portion, and floating is also needed in this tilt direction.

Patent Document 1 (and FIGS. 19 and 20 in particular) discloses a connector with which floating is possible under such insertion of a connected circuit board.

The connector of Patent Document 1 has a terminal comprising an elastic portion (relay portion) that enables floating and a housing that supports the terminal. This housing has a stationary housing (first support portion) that is fixed to a circuit board, a movable housing (second support portion) that is located above and away from the stationary housing, and a linking portion that links the stationary housing and the movable housing and is integrally molded with the two housings.

The terminal is supported by the stationary housing at one place on the terminal and is supported by the movable housing at another place, so as to span the movable housing and the stationary housing. This terminal has the elastic portion (relay portion) that permits floating of the movable housing while maintaining the movable housing in a position that is away from the stationary housing as mentioned above.

The movable housing has an input port for the connected circuit board, and the interior therebelow is a space that accommodates the connected circuit board and the contact portions of two terminals which clamp the connected circuit board. The contact portions are provided to arms that are bent in an inverted U shape, the elasticity of which allows the contact portions to spread apart when the connected circuit board is inserted into a space therebetween, while the board is clamped by the contact portions upon insertion into this space. The arms are partially supported by the movable housing.

The terminals each have an elastic portion that forms a horizontal U shape between the separated stationary housing and movable housing, and the connected circuit board that is clamped between the contact portions of two terminals within the movable housing can float in a direction perpendicular to the connection direction, according to what is stated in Patent Document 1.

PRIOR ART DOCUMENTS

Patent Document

Patent Document 1: Japanese Patent Application 2002-050420

SUMMARY

Problems to be Solved by the Invention

According to the description in Patent Document 1, the connected circuit board that is clamped by the contact portions of terminals in the space of the movable housing and held in the insertion opening of the movable housing is capable of floating (relative displacement with respect to the stationary housing) in two directions perpendicular to the connection direction along with the movable housing.

However, in Patent Document 1, since the stationary housing and the movable housing are integrally linked by a linking portion that is relatively wide, albeit thin, the linking portion does not undergo elastic displacement (does not stretch) in the connection direction (the up and down direction), so the movable housing is incapable of floating with respect to the stationary housing in this direction. Also, although it is stated in Patent Document 1 that floating is possible in two directions perpendicular to the above-mentioned connection direction, in the width direction (one of the two directions) of the linking portion, there is no elastic displacement of the linking portion, so floating should be considered impossible in this direction as well. As to the above-mentioned linking portion, of the two directions perpendicular to the connection direction, the movable housing is only able to float in the connector lengthwise direction (at a right angle to the plane of the linking portion), and to float in a tilt direction coinciding with rotation around a line extending in the lengthwise direction of the connector.

Let us now turn our attention to the terminals. Two terminals can be elastically displaced at the horizontal U-shaped elastic portion in the direction in which the legs of the horizontal U shape open or close, but when the legs of both terminals open or close, that means that the movable housing is being displaced in the up and down connection direction, but this displacement of the movable housing is negated by the presence of the linking portion, so the movable housing ends up being incapable of floating in this direction. Also, in the lengthwise direction of the U-shaped legs, which is the same as the width direction of the linking portion, the legs do not extend, and when this is taken into account along with the fact that the linking portion does not undergo displacement in its width direction, the movable housing cannot float in this direction, either. On the other hand, when one of the legs is opened and the other is closed, the movable housing is able to float in a tilt direction that rotates around a line extending in the lengthwise direction of the connector.

Thus, the possible floating directions in Patent Document 1 are the lengthwise direction of the connector and the tilt direction coinciding with rotation around a line in this direction.

Therefore, it must be concluded that floating is either impossible or difficult in the connection direction and in one of the two directions perpendicular to the connecting direction (the width direction of the linking portion), which is needed when the counterpart connected member is to be a connected circuit board.

The present invention was conceived in light of the above situation, and it is an object thereof to provide an electrical connector for a circuit board with which floating is easily possible even in directions that were considered impossible or difficult in the past, so that the situation will be favorable even when the counterpart connected member is a connected circuit board.

Means for Solving the Problems

Implementations described herein are configured to provide an electrical connector for a circuit board, with which a counterpart connected circuit board can be sufficiently floated.

The electrical connector for a circuit board pertaining to the present invention has terminals on which connection portions for connecting to a circuit board are formed on one end side and contact portions for making contact with a counterpart connected circuit board are formed on the other end side, and a housing that supports said terminals, said housing having a stationary housing for attaching to a circuit board via the terminals, and a movable housing that is formed as a separate member from the stationary housing and is able to move with respect to the stationary housing, and said counterpart connected circuit board coming into contact with the contact portions of the terminals on the movable housing side.

With this electrical connector for a circuit board of the present invention, the terminals each have a stationary-side supported portion that is supported by the stationary housing, a movable-side supported portion that is supported by the movable housing, and an elastic portion that links the stationary-side supported portion and the movable-side supported portion and is capable of elastic displacement, and the elastic portions each have longitudinal portions extending in the connector mating direction and lateral portions extending in a direction perpendicular to the mating direction, and bent portions are formed by being bent at the inner ends of the lateral portions.

With the present invention configured this way, the movable housing and the stationary housing are formed separately from each other and are linked only by the elastic portions of the terminals, and in addition, the elastic portions have longitudinal portions and lateral portions, so floating is possible in the connection direction and in both of the two directions perpendicular to the connection direction due to the elastic bending displacement of the longitudinal portions and lateral portions. Furthermore, the elastic bending displacement of the longitudinal portions and lateral portions makes floating possible in a tilt direction coinciding with rotation around a line in the connector lengthwise direction (a direction perpendicular to both the connection direction and the connector width direction).

With the present invention, the elastic portions of the terminals each include longitudinal portions, lateral portions, and a bent portion linked in that order to the movable-side supported portion, and the bent portion is linked to the stationary-side supported portion.

With the present invention, it is preferable if the longitudinal portions of a terminal are formed longer than the lateral portions, and at least a portion of the longitudinal portions is located within the range of the movable-side housing in the connector mating direction. Thus locating at least a portion of the longitudinal portions within the range of the movable housing ensures enough length for the longitudinal portions to bend, while also making the connector more compact in the connection direction.

With the present invention, it is preferable if a pair of terminals is such that the movable-side supported portions of said terminals are located more to the inside in the connector width direction than the stationary-side supported portions. This moves the movable-side supported portions closer to the position of the contact portions of the terminals in the connector width direction, so even if a strong insertion or removal force is exerted on the contact portions when the counterpart connected circuit board is inserted or removed, the holding force at the movable-side supported portions of the terminals will be large enough to resist the insertion or removal force.

With the present invention, at least the elastic portions of the terminals can be bent in the sheet thickness direction of the terminals. When the elastic portions are thus configured, they readily bend in the sheet thickness direction, allowing float to be increased.

Effects of the Invention

As discussed above, with the present invention, terminals are attached so as to span a stationary housing and a movable housing formed as separate members, and elastic portions having longitudinal portions and lateral portions are provided to the terminals, so elastic bending displacement at the longitudinal portions and lateral portions allows the movable housing to undergo linear displacement in the connection direction and in two directions perpendicular thereto, allowing for floating at a tilt coinciding with rotation around a line in these directions. As a result, even if the counterpart connected member is a connected circuit board, good floating characteristics can be obtained in all the necessary directions.

DETAILED DESCRIPTION

An embodiment of the present invention will now be described through reference to the appended drawings.

Figure 1A:
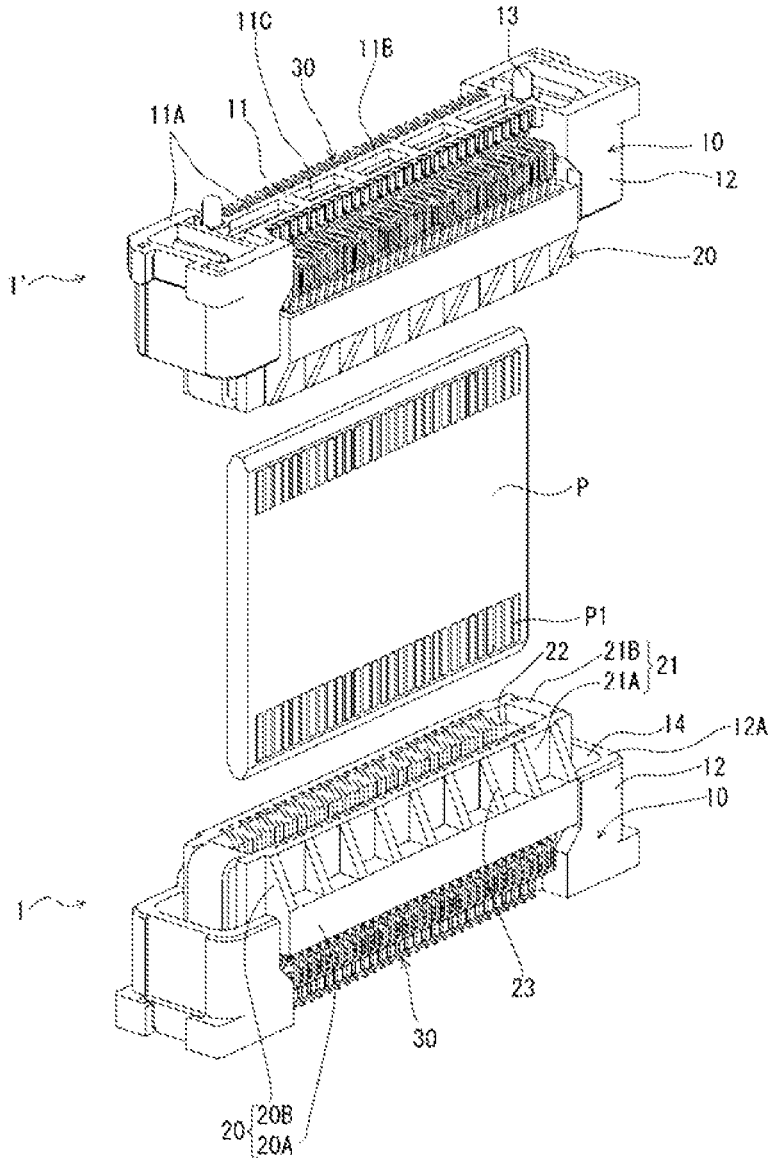
FIG. 1A illustrates an oblique view of the overall appearance of a middle board serving as a counterpart connected circuit board with connectors in an embodiment of the present invention, showing the state before the middle board is connected.
Figure 1B:
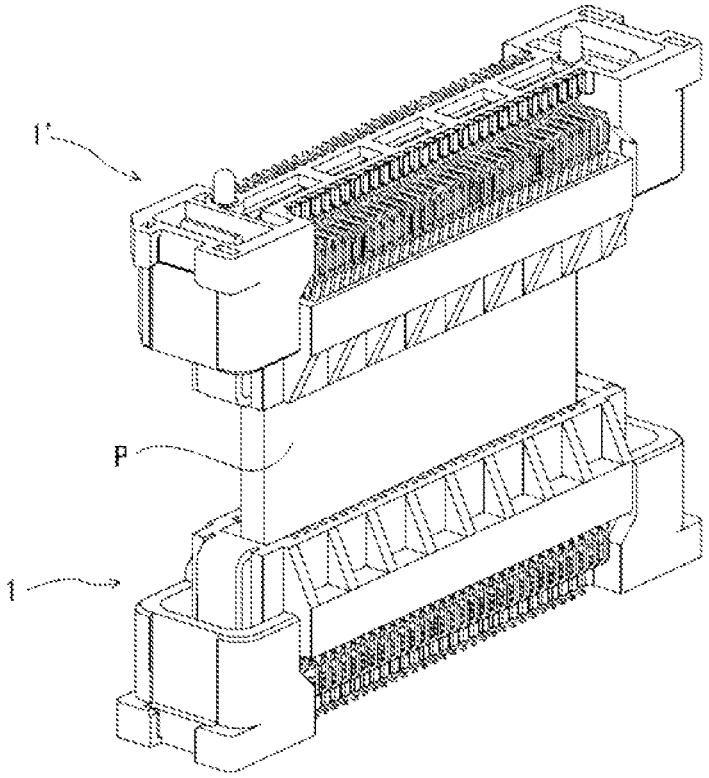
FIG. 1B illustrates an oblique view of the state after the connectors and the middle board have been connected.

FIGS. 1A and 1B are oblique views showing the appearance of the electrical connector for a circuit board of this embodiment (hereinafter referred to as "connector") and a middle board, with said connector serving as a counterpart connected circuit board. FIG. 1A is the state before connection to the middle board, and FIG. 1B is the state after connection.

In FIG. 1A, two connectors 1 and 1' that have the same configuration are positioned vertically with one facing up and the other facing down. A single middle board P that is vertically symmetrical and serves as the counterpart connected circuit board is located between the connectors 1 and 1'. The two connectors 1 and 1' are used by attaching their attachment faces to a circuit board (not shown). Although the connectors 1 and 1' have the same configuration, in order to make it easier to understand their vertical positional relation in the drawing, the lower one is labeled 1 and the upper one is labeled 1' (no distinction is made between the various components and members in the connectors).

The two identical connectors 1 and 1' are depicted such that the portion that cannot be seen in the lower connector 1 in FIG. 1A is visible in the upper connector 1', so the description will make reference to the upper connector 1' and the lower connector 1 as appropriate. Since the two connectors 1 and 1' are oriented in opposite directions vertically in FIG. 1A, the side of the upper connector 1' that is facing upward and appears in the drawing is used as the attachment face and the connector is attached at this attachment face to a circuit board (not shown in FIG. 1A; see FIG. 4A), and the side of the lower connector 1 that is facing downward and does not appear in the drawing is used as the attachment face and the connector is attached at this attachment face to another circuit board (not shown in FIG. 1A; see FIG. 4A). Therefore, in FIG. 1A, with the connector 1', the above-mentioned attachment face side is shown, but the mating side that faces the middle board is not shown. In contrast, with the lower connector 1, the attachment face side is not shown, but the mating side is shown.

With the present invention, the housing that supports the terminals is separated into a stationary housing and a movable housing. Therefore, the connector 1 has a stationary housing 10 that is fixed to a circuit board, a movable housing 20 that is separate from the stationary housing 10 and is able to move relatively with respect to the stationary housing 10, and a plurality of terminals 30 that span the stationary housing 10 and the movable housing 20 and movably support the movable housing 20.

The terminals 30 in FIG. 1A are arranged in two rows (on the right and left sides) facing each other in pairs that are in left-right symmetry. Therefore, the stationary housing 10 and the movable housing 20 are in left-right symmetry as well, and support the terminals 30 on both sides.

The stationary housing 10 is made of an electrically insulating material, and has a bottom wall portion 11 on which the attachment face to the circuit board is formed and which extends in the arrangement direction of the terminals 30, and end wall portions 12 that rise up from the bottom wall portion 11 at both ends of the bottom wall portion 11 in the terminal arrangement direction. The end wall portions 12 each have an accommodation space 14 for holding part of the end portion of the movable housing 20, formed on the inner faces that are opposite each other and form a horizontal U shape when viewed in the up and down direction. An attachment face 11A that is opposite the circuit board is formed on the bottom face of the bottom wall portion 11, and protrusions 13 that fit into corresponding holes in the circuit board for positioning are provided to the attachment face 11A. Empty windows 11C are provided to the attachment face 11A for the purposes of molding the stationary housing 10 and making it more lightweight, to the extent that its function is not affected.

The movable housing 20 is made of the same electrically insulating material as the stationary housing 10. The lower half portion 20A at both ends extending in the terminal arrangement direction is held in the accommodation spaces 14 formed at the end wall portions 12 of the stationary housing 10. The upper half portion 20B of the movable housing 20 protrudes above the upper faces 12A of the end wall portions 12 of the stationary housing 10, and the side faces of the lower half portion 20A where part of the terminals 30 is disposed are exposed between the two end wall portions 12. A peripheral wall 21 made up of side walls 21A and end walls 21B opens upward from the upper half portion 20B of the movable housing 20, and a receptacle 22 having a groove-shaped space for accepting a connected circuit portion P1 that is formed at the end edges of the middle board P is formed. The side walls 21A of the peripheral wall 21 have a plurality of ribs 23 on their outer faces for reinforcement.

Connectors 1 and 1' that have the stationary housing 10, the movable housing 20, and the terminals 30 and that have been put into the opposite vertical orientation shown in FIG. 1A are each attached to a circuit board (not shown), and in this state are located above and below the middle board P and are ready for connection by the middle board P. After this, the middle board P is connected to the lower connector 1 and then the upper connector 1' is connected to the middle board P, or the middle board P is connected to the upper connector 1' and then the middle board P is connected to the lower connector 1, to obtain the state in FIG. 1B.

Next, the internal structure of the connector 1 having the appearance described above will be described through reference to FIGS. 2A, 2B, and 3.

Figure 2A:
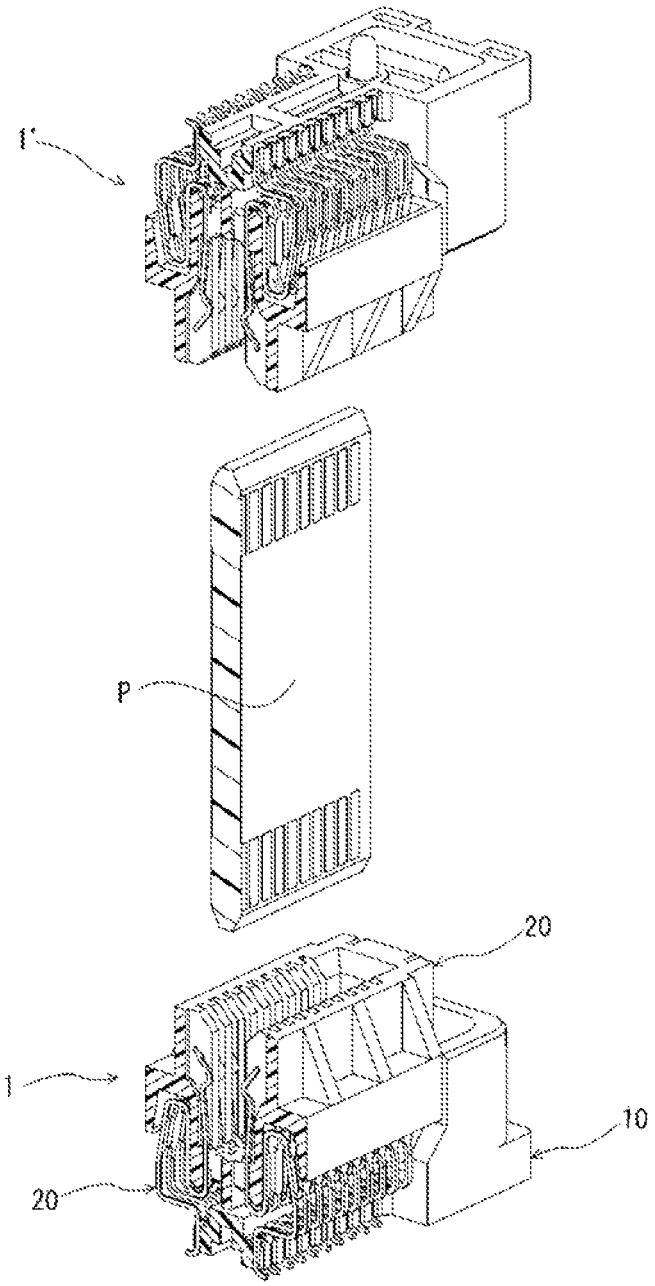
FIG. 2A illustrates a cross sectional oblique view of the state before connection of the middle board and the connectors corresponding to FIG. 1A.
Figure 2B:
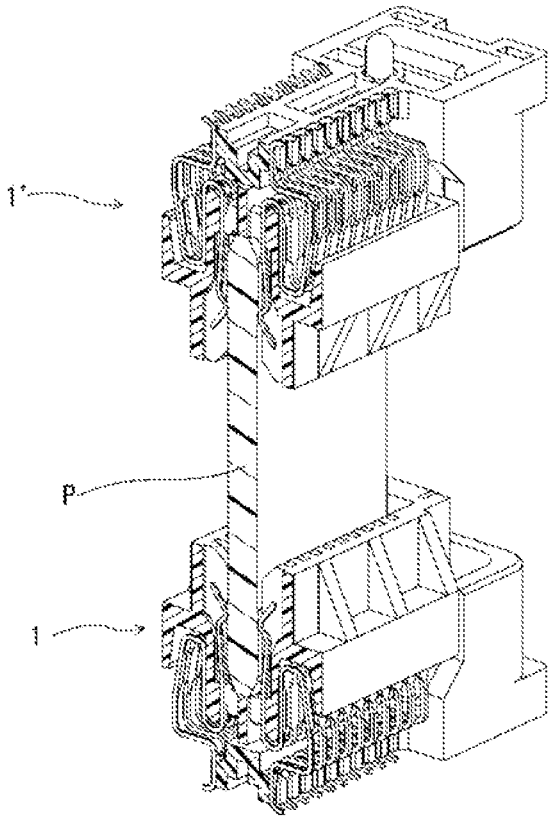
FIG. 2B illustrates an oblique view of the state after connection of the middle board and the connectors in FIG. 1B.
Figure 3:
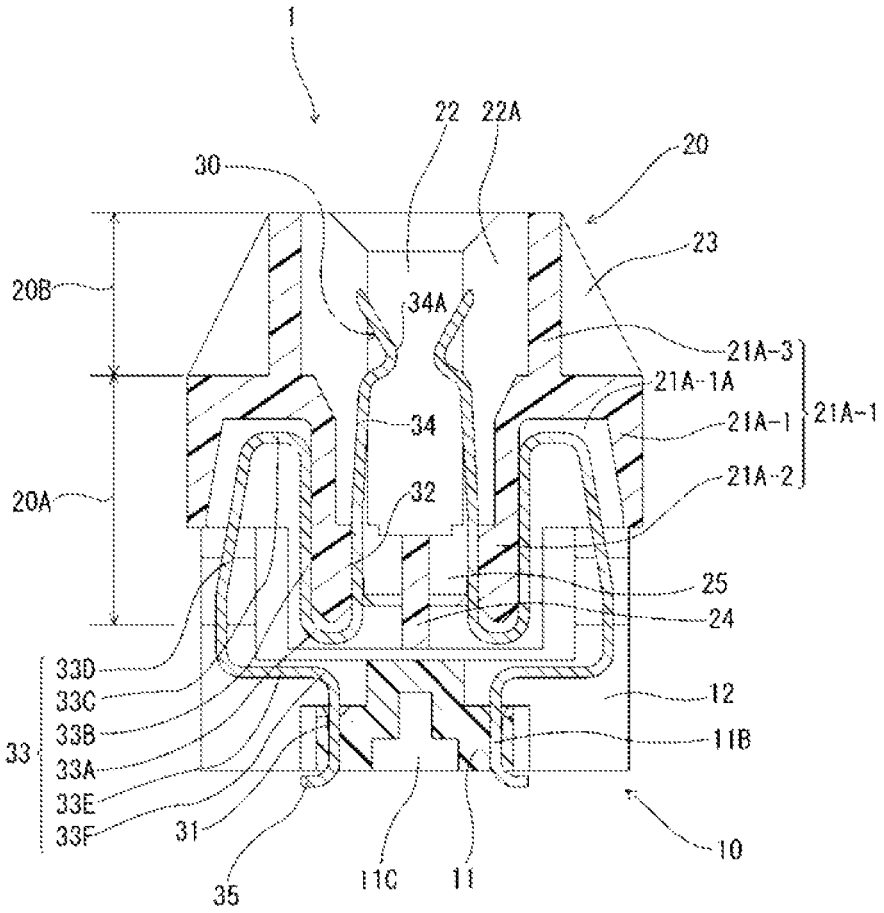
FIG. 3 illustrates a detail cross section of the lower connector in FIGS. 1A and 2A.

FIGS. 2A and 2B are each a cross sectional oblique view. FIG. 2A is before connection to the middle board, and FIG. 2B is after connection. FIG. 3 is a detail cross section of the lower connector. Since the upper connector and the lower connector have the same structure and are merely used in a vertically inverted orientation, only the lower connector 1 is shown in FIG. 3.

As discussed above, the connector 1 has a stationary housing 10, a movable housing 20, and terminals 30.

With the stationary housing 10, the bottom wall portion 11 linking the end wall portions 12 located at both ends in the terminal arrangement direction is smaller than the end wall portions 12 in the width direction in FIG. 3 (the lateral direction in FIG. 3) and extends at a right angle to the viewing plane in FIG. 3. Terminal holding holes 11B that vertically pass through the ends in the above-mentioned width direction are formed in the bottom wall portion 11, and the windows 11C are also provided.

The movable housing 20, as already mentioned with reference to FIG. 1A, is made up of the lower half portion 20A located below the upper faces 12A of the end wall portions 12 of the stationary housing 10, and the upper half portion 20B located above the upper faces 12A. As seen in FIG. 1A, of the peripheral wall 21, the lower portions of the end walls 21B extending vertically at both ends in the terminal arrangement direction constitute part of the lower half portion 20A and are held in the accommodation spaces 14 formed in the end wall portions 12 of the stationary housing 10, and the upper portions of the end walls 21B protrude upward from the accommodation spaces 14. Meanwhile, of the peripheral wall 21, the side walls 21A that link the end walls 21B are such that the range of the lower half portion 20A is located below the upper faces 12A of the end wall portions 12 of the stationary housing 10 and between the end wall portions 12 in the terminal arrangement direction, and the range of the upper half portion 20B protrudes higher than the upper faces 12A.

As seen in FIG. 3, the side walls 21A are such that the range of the lower half portion 20A in the up and down direction includes terminal accommodating walls 21A-1 that are wider in the lateral direction, terminal holding walls 21A-2 that are narrower and hang down from the terminal accommodating walls 21A-1, and guide walls 21A-3 that constitute the range of the upper half portion 20B and rise upward in a narrow width from the upper faces of the terminal accommodating walls 21A-1. The terminal holding walls 21A-2 are linked together by a bottom wall 24. Terminal holes 25 are formed in the bottom wall 24 at positions corresponding to the terminals 30 in the terminal arrangement direction, so that part of the terminals 30 can be inserted and held therein when the terminals 30 are installed in two rows. Terminal accommodation grooves 21A-1A that open downward are formed in the terminal accommodating walls 21A-1 at positions corresponding to the terminals 30 in the terminal arrangement direction, and the outer bent portions of the terminals (discussed below) are housed therein so as to allow elastic displacement.

The guide walls 21A-3 that rise up from the upper faces of the terminal accommodating walls 21A-1 combine with the terminal accommodating walls 21A-1 to form the receptacle 22 that accepts the connected circuit portion P1 of the middle board P (the counterpart connected circuit board). As seen in FIG. 3, terminal grooves 22A that accommodate part of the terminals (discussed below) so as to allow elastic displacement are formed on the opposing inner faces of the receptacle 22 at positions corresponding to the terminals in the terminal arrangement direction. These terminal grooves 22A are shallower within the range of the terminal accommodating walls 21A-1, which are the lower portions of the terminal grooves 22A, and are deeper within the range of the guide walls 21A-3, which are the upper portions, to match the shape of the terminals 30. The above-mentioned reinforcing ribs 23 are provided to the outer faces of the guide walls 21A-3.

The terminals 30 are made by bending a long strip of metal in its sheet thickness direction. As seen in FIG. 3, the terminals 30 are each mainly composed of a stationary-side supported portion 31 that is supported by the stationary housing 10, a movable-side supported portion 32 that is supported by the movable housing 20, an elastic portion 33 that links the stationary-side supported portion 31 and the movable-side supported portion 32 and is bent to allow elastic bending displacement, a contact arm 34 that extends upward from the movable-side supported portion 32, and a connecting portion 35 that extends out along the bottom face from the stationary-side supported portion 31.

The stationary-side supported portions 31 have a straight shape extending up and down and are press-fitted into the terminal holding holes 11B of the stationary housing 10. Fixing protrusions (not shown) are provided to the side end faces thereof (the side end faces located on both sides in a direction perpendicular to the viewing plane in FIG. 3). Therefore, the terminal holding holes 11B have an inside width (the width in the left and right direction in FIG. 3) that affords some leeway with respect to the stationary-side supported portions 31 in the sheet thickness direction of the stationary-side supported portions 31, but the inside width in a direction perpendicular to the viewing plane is substantially equal to the width of the stationary-side supported portions 31, so the fixing protrusions bite into the corresponding faces of the terminal holding holes 11B, which positions the stationary-side supported portions 31 and prevents them from coming loose.

The lower portions of the stationary-side supported portions 31 protrude from the bottom face of the stationary housing 10, are bent in an approximate L shape, and constitute the connecting portions 35 that are soldered to the circuit board.

The movable-side supported portions 32 extend straight up and down, just like the stationary-side supported portions 31, and are press-fitted into the terminal holes 25 of the movable housing. The movable-side supported portions 32 are similar to the stationary-side supported portions 31 in that they are provided with fixing protrusions (not shown) on their side end faces. After being inserted into the wide terminal holes 25 (FIG. 3), the fixing protrusions bite into the corresponding faces of the terminal holes 25, which are perpendicular to the viewing plane, at fixed positions, which positions the movable-side supported portions 32 and prevents them from coming loose. The terminal holes 25 are wider than the terminal holding holes 11B used for the stationary-side supported portions 31 (discussed above), the reason for which is that contact portions 34A are larger and are bent in the sheet thickness direction as discussed below during installation of the terminals, and these holes are used to insert these contact portions 34A.

The contact arms 34 of the terminals 30 extend upward from the movable-side supported portions 32, and these contact arms 34 are accommodated in the terminal grooves 22A of the movable housing 20 so as to allow elastic bending displacement. These contact arms 34 are bent in the sheet thickness direction so that their upper end portions have a peaked shape, the apexes of the peaks constitute the contact portions 34A that come into contact with the middle board, and only the contact portions 34A protrude from the terminal grooves 22A. The contact arms 34 of the two terminals 30 in a left/right pair are constricted inward moving up, so that the contact portions 34A move much closer together. Therefore, since the contact pressure is high on the middle board at the regular position, the middle board is firmly clamped and supported, so sufficient contact pressure can be ensured even if the middle board is tilted in floating.

The elastic portions 33 that link the movable-side supported portions 32 and the stationary-side supported portions 31 each have an inner bent portion 33A that forms a U shape with respect to the lower end of the movable-side supported portion 32, an inner longitudinal portion 33B that extends straight up from the inner bent portion 33A, an outer bent portion 33C that is bent in an inverted U shape at the upper end of the inner longitudinal portion 33B, an outer longitudinal portion 33D that extends down from the outer bent portion 33C, and a lateral portion 33E that extends in the lateral direction and is bent inward from the lower end of the outer longitudinal portion 33D. The lateral portions 33E also go all the way to the upper ends of the stationary-side supported portions 31 via the bent portions.

The inner bent portions 33A of the elastic portions 33 are located so as to go around the lower end portions of the terminal holding walls 21A-2, and as a result, the inner longitudinal portions 33B of the elastic portions 33 are substantially touching the outer faces of the terminal holding walls 21A-2 over the entire length of the inner longitudinal portions 33B. The outer bent portions 33C that are contiguous with the upper ends of the inner longitudinal portions 33B are accommodated in the terminal accommodation grooves 21A-1A of the movable housing 20, and can undergo elastic bending displacement within the terminal accommodation grooves 21A-1A.

The outer longitudinal portions 33D are inclined outward in the width direction and downward over the range from the outer bent portions 33C to near the lateral portions 33E, and extend in a direction of hanging down near the lateral portions 33E. These lateral portions 33E are linked via stationary-side bent portions 31F to the stationary-side supported portions 31. Thus, the elastic portions 33 from the inner bent portions 33A to the lateral portions 33E are able to undergo elastic bending displacement under an external force. The inner longitudinal portions 33B are displaced so as to incline away from the outer faces of the terminal holding walls 21A-2 as a result of displacement of the inner bent portions 33A, the outer longitudinal portions 33D are displaced so as to incline inward or outward as a result of displacement of the outer bent portions 33C and are also displaced upward as a result of bending displacement of the lateral portions 33E as well as the stationary-side bent portions 33F, that is, the lateral portions 33E undergo bending displacement as a result of upward displacement of the outer bent portions 33C. At this point, since the lateral portions 33E undergo bending displacement with the elastically displaced stationary-side bent portions 33F serving as the fulcrum, the displacement is larger. Thus, by displacement of the various portions, the elastic portions 33 can be displaced both longitudinally and laterally overall.

The terminals 30 are arranged in pairs in left and right symmetry. The distance between the contact portions 34A of a pair of terminals 30 is somewhat less than the thickness of the middle board that is inserted into the receptacle 22 of the movable housing 20.

Therefore, as in FIG. 2A, when the unconnected middle board P and the connectors 1 and 1' are readied and the middle board P is then inserted into the receptacle 22, as seen in FIG. 2B, the contact portions 34A on both sides are pushed outward in the width direction, that is, the contact portions 34A are pushed into the terminal grooves 22A, applying pressure that moves the contact portions 34A farther apart and effecting elastic displacement, which ensures good contact pressure between the contact portions 34A and the connected circuit portion P1 of the middle board P.

Figure 4A:
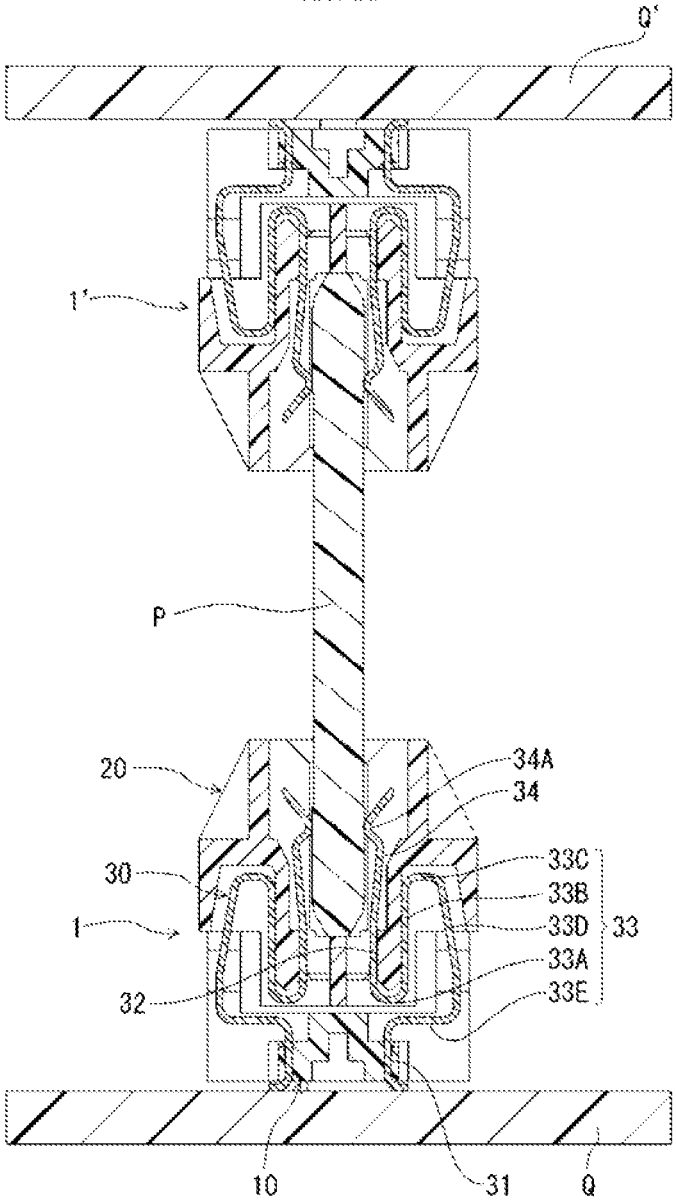
FIG. 4A illustrates a cross section in the state shown in FIG. 2B in which the connectors and the middle board have been connected.

Thus, as in FIG. 2B, in a state in which the two connectors 1 and 1' connected by the middle board P are attached to respective circuit boards Q and Q', if deviation should occur between the circuit boards Q and Q' in the lateral direction (the direction along the planes of the circuit boards Q and Q'), for example, the connectors 1 and 1' float based on the following behavior. This state is shown in the cross sections of FIGS. 4A and 4B. FIG. 4A corresponds to FIG. 2B and shows how the middle board is connected in a normal state to the two connectors, and FIG. 4B shows what happens when there is deviation from the normal state.

The terminals 30 connected to the middle board P in the normal state seen in FIG. 4A are such that their elastic portions 33, that is, the inner bent portions 33A, the inner longitudinal portions 33B, the outer bent portions 33C, the outer longitudinal portions 33D, and the lateral portions 33E, are not elastically displaced, and the inner longitudinal portions 33B are touching the outer faces of the terminal holding walls 21A-2 over their entire length.

Then, if the connector 1' located above shifts along with the circuit board Q' to the left with respect to the connector 1 located below, the lower and upper connectors 1 and 1' undergo the same elastic displacement at the elastic portions 33 of their terminals 30, resulting in a floating state, and the middle board P is connected to the connectors 1 and 1' in a tilted orientation.

Figure 4B:
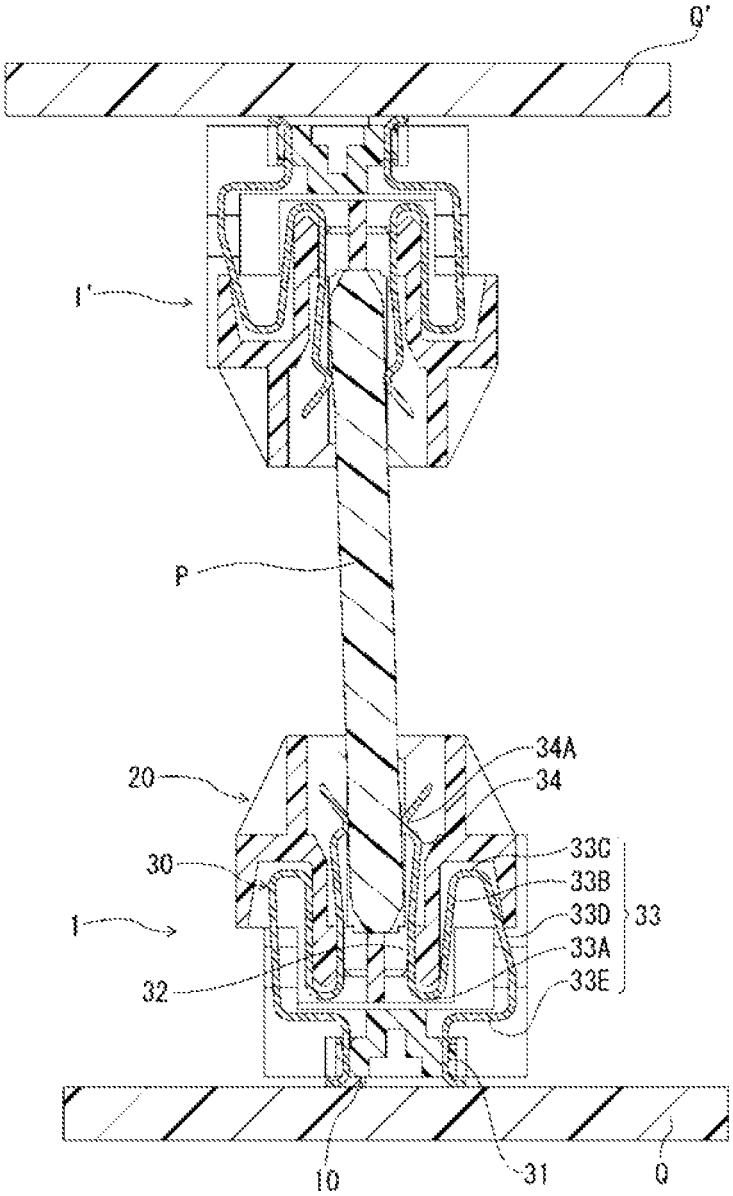
FIG. 4B illustrates a cross section of the state when the connectors in FIG. 4A have been shifted over from the normal state.

As seen in FIG. 4B, in a floating state, the inner longitudinal portions 33B of the terminals 30 on the right side of the lower connector 1 are tilted at the fulcrum of the inner bent portions 33A by the spreading apart of the inner bent portions 33A, and incline far away from the terminal holding walls 21A-2 at the upper ends of the inner longitudinal portions 33B.

Then, since the adjacent stationary-side supported portions 31 are supported by the stationary housing 10, the lateral portions 33E of the terminals 30 cannot be displaced in the lateral direction, and therefore the outer longitudinal portions 33D linked to the lateral portions 33E incline due to the spreading apart of the outer bent portions 33C, widening the space between the lower ends of the outer longitudinal portions 33D and the inner bent portions 33A.

Meanwhile, with the terminals 30 on the left side of the lower connector 1, the inner longitudinal portions 33B stay in contact with the outer faces of the terminal holding walls 21A-2 while the outer bent portions 33C are displaced in the direction of moving closer together, narrowing the space between the inner bent portions 33A and the lower ends of the outer longitudinal portions 33D.

Thus causing elastic displacement in opposite directions between the terminals 30 on the right side and the terminals 30 on the left side makes it possible for the movable housing 20 to float toward the left with respect to the stationary housing 10, and the middle board P that is clamped between the contact portions 34A of the terminals 30 is able to incline, with these contact portions 34A as the fulcrum.

With the present invention, the longitudinal portions (the inner longitudinal portions 33B and outer longitudinal portions 33D) and the lateral portions 33E are provided to the elastic portions 33, but the longitudinal portions may consist of just the outer longitudinal portions 33D. The outer longitudinal portions 33D can themselves incline through spreading apart or squeezing together the outer bent portions 33C, and can also be displaced upward by bending displacement of the lateral portions 33E. The left and right floating in FIG. 4B corresponds to inclination of the outer longitudinal portions 33D, but if there is positional deviation of the two connectors 1 and 1' in the contact separation direction in the up and down direction, this can be handled by sliding the middle board P in the up and down direction, but even if the clamping pressure at the contact portions 34A is so high that sufficient sliding is impossible, this can be dealt with by using the bending displacement of the lateral portions 33E to displace the outer longitudinal portions 33D up and down. Although not shown in the drawings, with the present invention, the movable housing 20 can be tilted along with tilting of the middle board P. In this event, the lateral portions 33E of the terminals 30 on one side drop downward and the lateral portions 33E of the terminals 30 on the other side rise upward, resulting in floating in the direction in which the movable housing 20 is tilted. This movement allows for the load on the middle board P in a twisted direction to be reduced.

A modified example of this embodiment will now be described through reference to FIG. 5A and FIG. 5B.

Figure 5A:
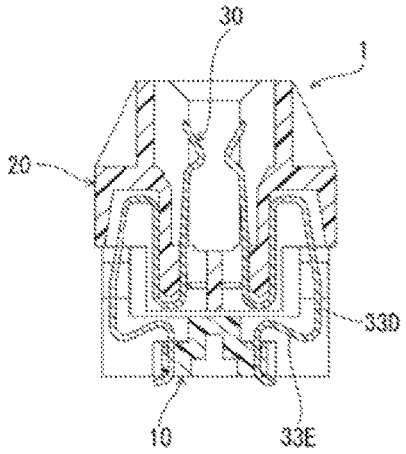
FIGS. 5A and 5B illustrate cross sections of modification examples of the connectors in FIGS. 1A and 2A, with FIG. 5A being one modification example, and FIG. 5B another modification example.

In the example in FIG. 5A, the lateral portions 33E of the terminals 30 are tilted downward toward the outside in the connector width direction. Therefore, compared to the example in FIG. 3, not only the lateral portions 33E but also the outer longitudinal portions 33D can be made longer, the amount of elastic bending displacement increases correspondingly, and there is more float.

Figure 5B:
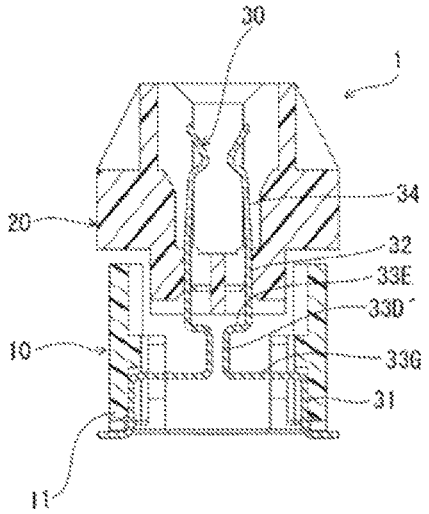

In the example in FIG. 5B, the bottom wall portion 11 of the stationary housing 10 is wider, the stationary-side supported portions 31 of the terminals 30 are located more toward the outside in connector width direction, the lateral portions 33E extend inward from the movable-side supported portions 32, the inner ends of the lateral portions 33E are bent in an L shape, and longitudinal portions 33D' are formed facing downward. These longitudinal portions 33D' are linked to the upper ends of the stationary-side supported portions 31 via a portion bent in a crank shape.

With this example in FIG. 5B, the stationary-side supported portions 31 are located toward the outside and the lateral portions 33E extend inward, and furthermore the longitudinal portions 33D' are close together, there is a large amount of elastic bending displacement in the tilt direction, and lower lateral portions 33G extending a long distance outward are provided further below, so adequate float of the movable housing 20 with respect to the stationary housing 10 can be ensured in the up and down direction, and not just tilt.

The terminals in the present invention can be modified. For example, the pairs of terminals need not be arranged symmetrically opposite each other, and their contact portions may be offset from one another in the arrangement direction or in the connector mating direction, or the contact portions may be disposed so that the terminals come into contact with only one side of the middle board.

DESCRIPTION OF THE REFERENCE CODES

1, 1' connector
10 stationary housing
20 movable housing
30 terminal
31 stationary-side supported portion
32 movable-side supported portion
33 elastic portion
33B longitudinal portion (inner longitudinal portion)
33D longitudinal portion (outer longitudinal portion)
33E lateral portion
34A contact portion
P counterpart connected circuit board (middle board)

The invention claimed is:

1. An electrical connector for a circuit board, comprising:

terminals on which connection portions for connecting to the circuit board are formed on one end side and contact portions for making contact with a counterpart connected circuit board are formed on the other end side, and a housing that supports said terminals, said housing having a stationary housing for attaching to the circuit board via the terminals, and a movable housing that is formed as a separate member from the stationary housing and is able to move with respect to the stationary housing, and said counterpart connected circuit board coming into contact with the contact portions of the terminals on the movable housing side, wherein each of the terminals has a stationary-side supported portion that is supported by the stationary housing, a movable-side supported portion that is supported by the movable housing, and an elastic portion that links the stationary-side supported portion and the movable-side supported portion and is capable of elastic displacement, and each of the terminals elastic portion has longitudinal portions extending in a mating direction of the electrical connector with the counterpart connected circuit board, and a lateral portion extending in a direction perpendicular to the mating direction, and bent portions are formed by being bent at inner ends of the lateral portion;

wherein at least a portion of the longitudinal portions is located inside the movable-side housing in the mating direction.

2. The electrical connector for a circuit board according to claim 1, wherein the elastic portion of each of the terminals has the longitudinal portions, the lateral portion, and the bent portion at the inner end of the lateral portion linked in that order to the movable-side supported portion, and the bent portion is linked to the stationary-side supported portion.

3. The electrical connector for a circuit board according to claim 1, wherein the longitudinal portions of each of the terminals are formed longer than the lateral portion.

4. The electrical connector for a circuit board according to claim 1, wherein a pair of said terminals is such that the movable-side supported portion of said terminals are located more to an inside in a connector width direction than the stationary-side supported portion.

5. The electrical connector for a circuit board according to claim 1, wherein at least the elastic portions of the terminals are bent in a sheet thickness direction of the terminals.

* * * * *